US010845168B1

(12) United States Patent
Rushing et al.

(10) Patent No.: US 10,845,168 B1
(45) Date of Patent: Nov. 24, 2020

(54) SHOOTING STALLS AND RANGES INCLUDING AIR PERMEABLE BARRIER

(71) Applicant: RATAS Investments, Inc., Spring, TX (US)

(72) Inventors: Brian K. Rushing, Houston, TX (US); Jose Quintanilla, Spring, TX (US)

(73) Assignee: RATAS Investments, Inc., Spring, TX (US)

( * ) Notice: Subject to any disclaimer, the term of this patent is extended or adjusted under 35 U.S.C. 154(b) by 0 days.

(21) Appl. No.: 16/544,802

(22) Filed: Aug. 19, 2019

(51) Int. Cl.
*F41J 11/00* (2009.01)
*E04C 2/52* (2006.01)
*E04H 3/14* (2006.01)

(52) U.S. Cl.
CPC ..... *F41J 11/00* (2013.01); *E04C 2/523* (2013.01); *E04H 3/14* (2013.01)

(58) Field of Classification Search
CPC ..... F41J 11/00; E04C 2/523; E04H 3/14
See application file for complete search history.

(56) References Cited

U.S. PATENT DOCUMENTS

| | | | | |
|---|---|---|---|---|
| 4,114,521 | A * | 9/1978 | Busch | F41J 11/00 454/188 |
| 4,164,901 | A * | 8/1979 | Everett | F41J 11/00 273/410 |
| 4,247,115 | A | 1/1981 | Nikoden, Jr. | |
| 4,598,631 | A | 7/1986 | Everett | |
| 5,846,128 | A | 12/1998 | Kramer | |
| 5,907,930 | A | 6/1999 | Ricco, Sr. | |
| 7,909,331 | B2 | 3/2011 | Halverson | |
| 7,942,420 | B2 | 5/2011 | Polovnev et al. | |
| 7,967,296 | B1 | 6/2011 | Halverson | |
| 10,048,046 | B1 * | 8/2018 | Iliev | F41J 11/00 |
| 10,082,371 | B2 * | 9/2018 | Atluri | F41J 5/14 |
| 2007/0117503 | A1 | 5/2007 | Warminsky | |
| 2014/0349564 | A1 | 11/2014 | Lamothe | |
| 2018/0172385 | A1 | 6/2018 | Hale | |
| 2018/0202778 | A1 | 7/2018 | Parks et al. | |

* cited by examiner

*Primary Examiner* — Patrick J Maestri
(74) *Attorney, Agent, or Firm* — McDonnell Boehnen Hulbert & Berghoff LLP

(57) ABSTRACT

A shooting stall includes a first wall, a second wall, and an air permeable barrier. The first wall includes an upstream end, a downstream end, and a side surface that extends between the upstream end and the downstream end. The second wall is disposed substantially parallel to the first wall, and the second wall includes an upstream end, a downstream end, and a side surface facing the first wall that extends between the upstream end and the downstream end. The air permeable member is disposed between the first wall and the second wall.

20 Claims, 11 Drawing Sheets

SHOOTING STALLS AND RANGES INCLUDING AIR PERMEABLE BARRIER

BACKGROUND

An indoor shooting range may include one or more shooting stalls for persons training with firearms. Each shooting stall may provide an enclosure for an occupant of the stall.

The shooting range may include an air handling system. The air handling system may be configured to remove toxic components from the air in the shooting range, including, for example, lead dust and other heavy metal dust from gunpowder.

SUMMARY

In one aspect, a shooting stall is disclosed. The shooting stall may include a first wall comprising an upstream end, a downstream end, and a side surface that extends between the upstream end and the downstream end; a second wall disposed substantially parallel to the first wall, the second wall comprising an upstream end, a downstream end, and a side surface facing the first wall that extends between the upstream end and the downstream end; and an air permeable barrier disposed between the first wall and the second wall.

In another aspect, a shooting stall is disclosed where the air permeable barrier is substantially perpendicular to the first wall.

In another aspect, a shooting stall is disclosed where the air permeable barrier comprises a diffuser.

In another aspect, a shooting stall is disclosed where the air permeable barrier comprises a screen.

In another aspect, a shooting stall is disclosed where the air permeable barrier comprises a grille.

In another aspect, a shooting stall is disclosed where the air permeable barrier comprises a perforated plate.

In another aspect, a shooting stall is disclosed where the air permeable barrier extends across a majority of the opening between the side surface of the first wall and the side surface of the second wall.

In another aspect, a shooting stall is disclosed where the air permeable barrier extends from the side surface of the first wall to the side surface of the second wall.

In another aspect, a shooting stall is disclosed that further includes an axis extending through the first wall and the second wall, where the axis is positioned between the upstream end and the downstream end of each of the first wall and second wall, and where the air permeable barrier is disposed at the axis.

In another aspect, a shooting stall is disclosed that further includes a shelf that extends between the first wall and second wall, wherein the air permeable barrier is disposed below the shelf.

In another aspect, a shooting stall is disclosed where the air permeable barrier extends from the shelf to a floor structure that supports the first wall and the second wall.

In another aspect, a shooting stall is disclosed where a free area of the air permeable barrier is in a range from 25% to 75% of a surface area of the air permeable barrier.

In another aspect, a shooting stall is disclosed where an open area of the air permeable barrier is adjustable.

In another aspect, a shooting stall is disclosed that further includes a second air permeable barrier disposed between the first wall and the second wall.

In another aspect, a shooting stall is disclosed where the second air permeable barrier is disposed at an upper end of the first wall and the second wall.

In another aspect, a shooting range is disclosed. The shooting range may include a plurality of walls that are substantially parallel and aligned such that an axis passes through the plurality of wall, each of the walls comprising an upstream end, a downstream end, a first side surface extending from the upstream end to the downstream end, and a second side surface extending from the upstream end to the downstream end, wherein the plurality of walls defines a plurality of shooting stalls, where a first shooting stall of the plurality of shooting stalls includes: a respective first side surface of a first wall of the plurality of walls, an opposing respective second side surface of a second wall of the plurality of walls, and a first air permeable barrier disposed between the first wall of the plurality of walls and the second wall of the plurality of walls.

In another aspect, a shooting range is disclosed where a second shooting stall of the plurality of shooting stalls comprises: a respective first side surface of a third wall of the plurality of walls, an opposing respective second side surface of a fourth wall of the plurality of walls, and a second air permeable barrier disposed between the third wall of the plurality of walls and the fourth wall of the plurality of walls.

In another aspect, a shooting range is disclosed where the first air permeable barrier has a first open area and the second air permeable barrier has a second open area, and where the first open area is different from the second open area.

In another aspect, a shooting range is disclosed that further includes an air handling system configured to move air through the shooting stalls.

In another aspect, a shooting range is disclosed where the air handling system moves air from an upstream end of the plurality of stalls to a downstream end of the plurality of stalls.

BRIEF DESCRIPTION OF THE DRAWINGS

The accompanying drawings, which are included to provide a further understanding of the disclosure, are incorporated in and constitute a part of this specification, illustrate embodiments of the disclosure.

DETAILED DESCRIPTION

I. Introduction

In a shooting range, an air handling system may be configured to remove toxic components in the air by providing an air supply that flows through the shooting range. For example, an occupant of a shooting stall may discharge (fire) his firearm at or behind a firing line, and the air supply may flow from upstream of the occupant through the firing line.

Disclosed herein are shooting stalls and ranges that include an air permeable barrier between the walls of the shooting stall. Beneficially, the air permeable barrier may cause, at least in part, an increase in velocity of air that flows across the firing line and away from the occupant. Such an increase in the velocity of the air may increase the removal of the toxic components from the air in the shooting range. In some implementations, the shooting stalls and ranges described herein may improve efficiency of the air handling system and/or reduce the cost of energy to operate the air handling system.

II. Example Apparatus

Figure 1:
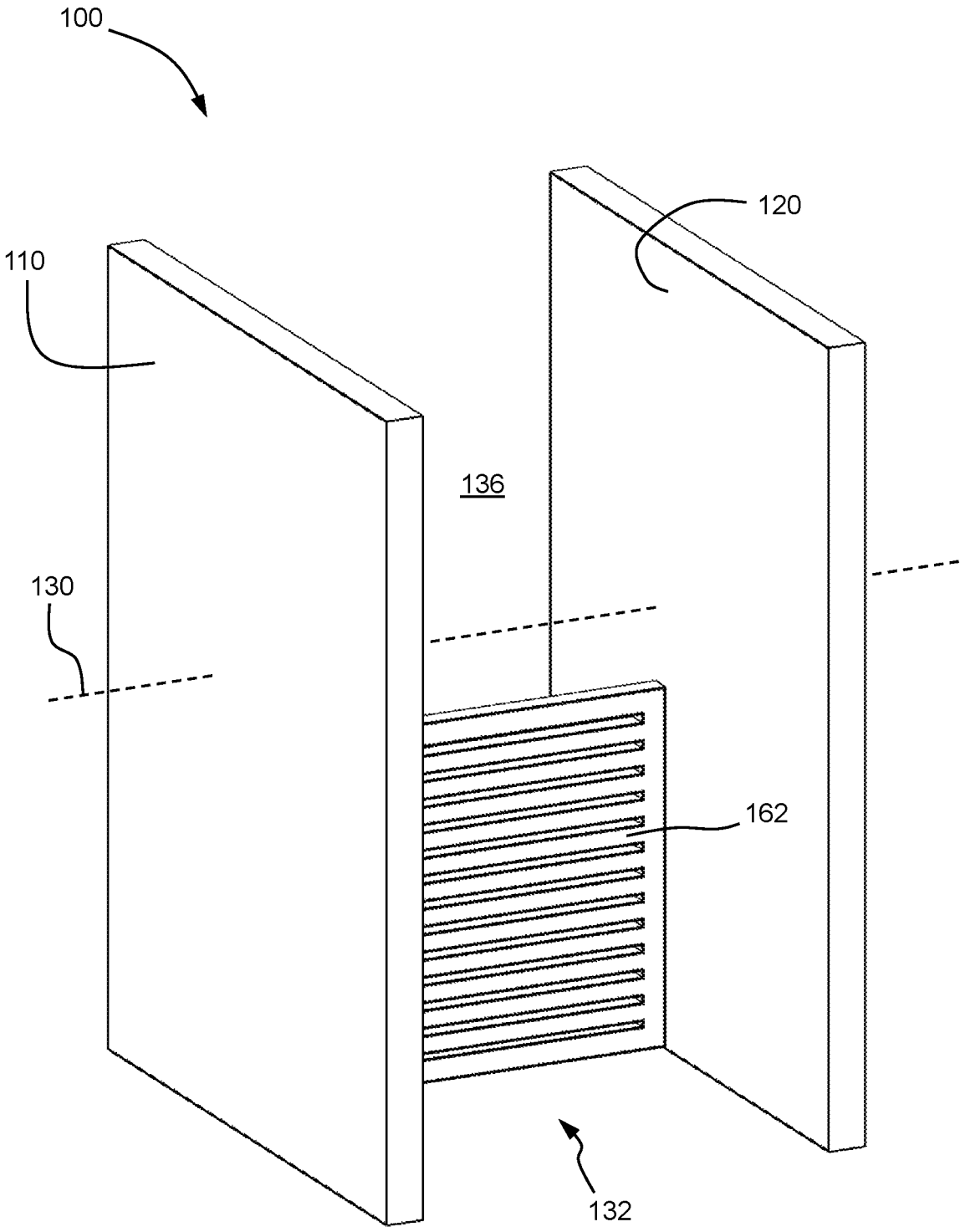
FIG. 1 shows a perspective view of a shooting stall, according to an example embodiment.
Figure 2:
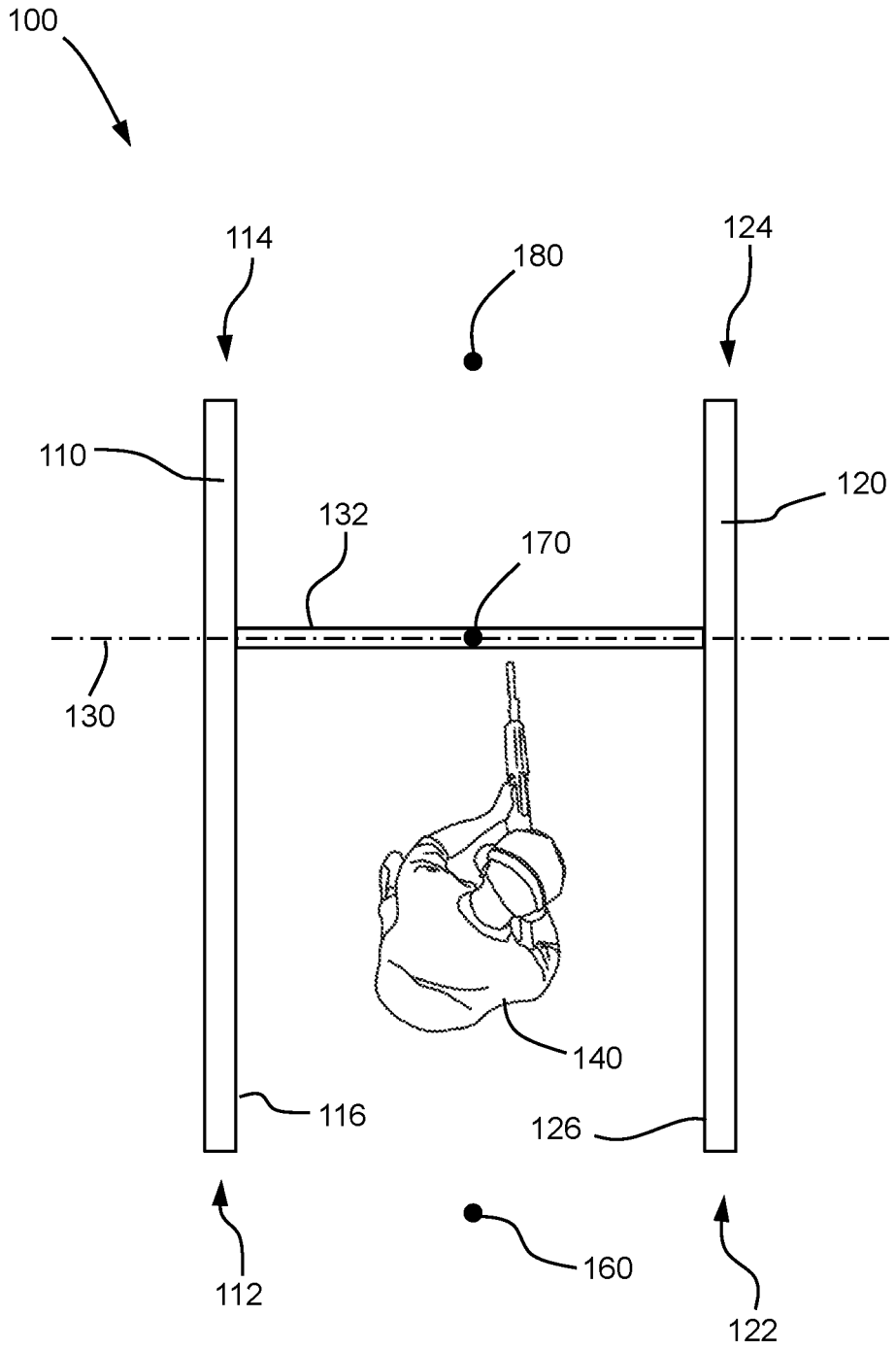
FIG. 2 shows a plan view of the shooting stall of FIG. 1.
Figure 3:
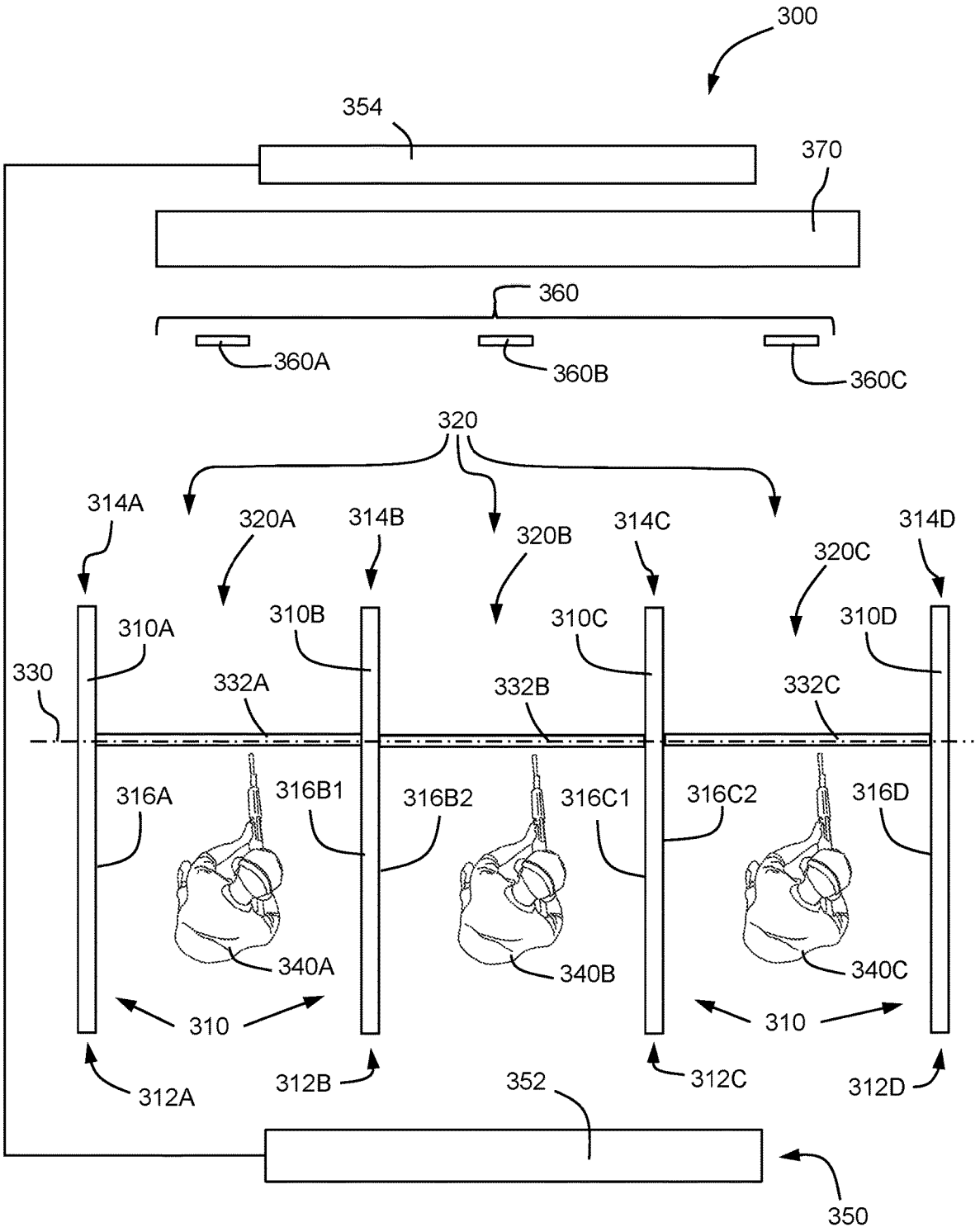
FIG. 3 shows aspects of a shooting range, according to an example embodiment.
Figure 6:
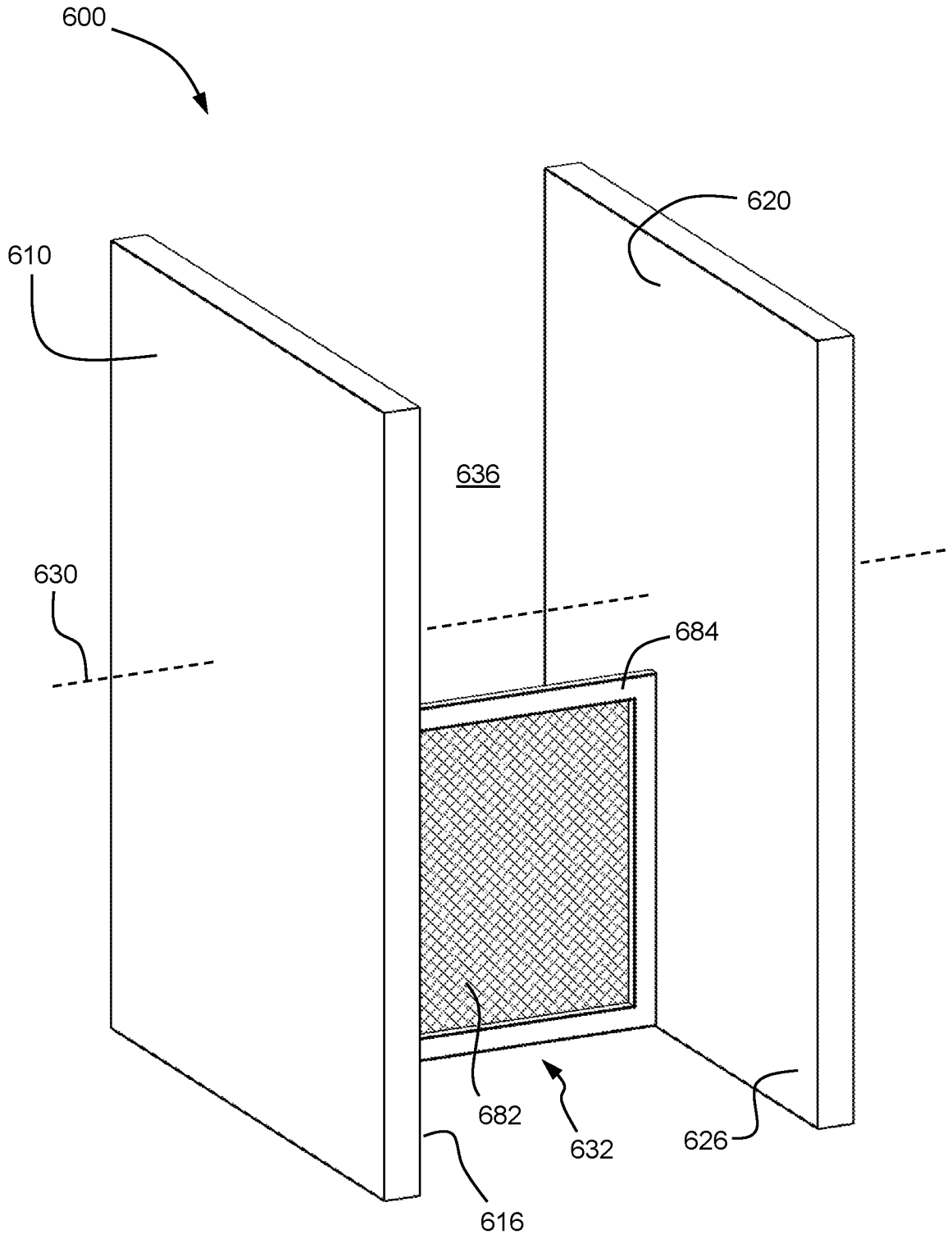
FIG. 6 shows a shooting stall, according to an example embodiment.
Figure 7:
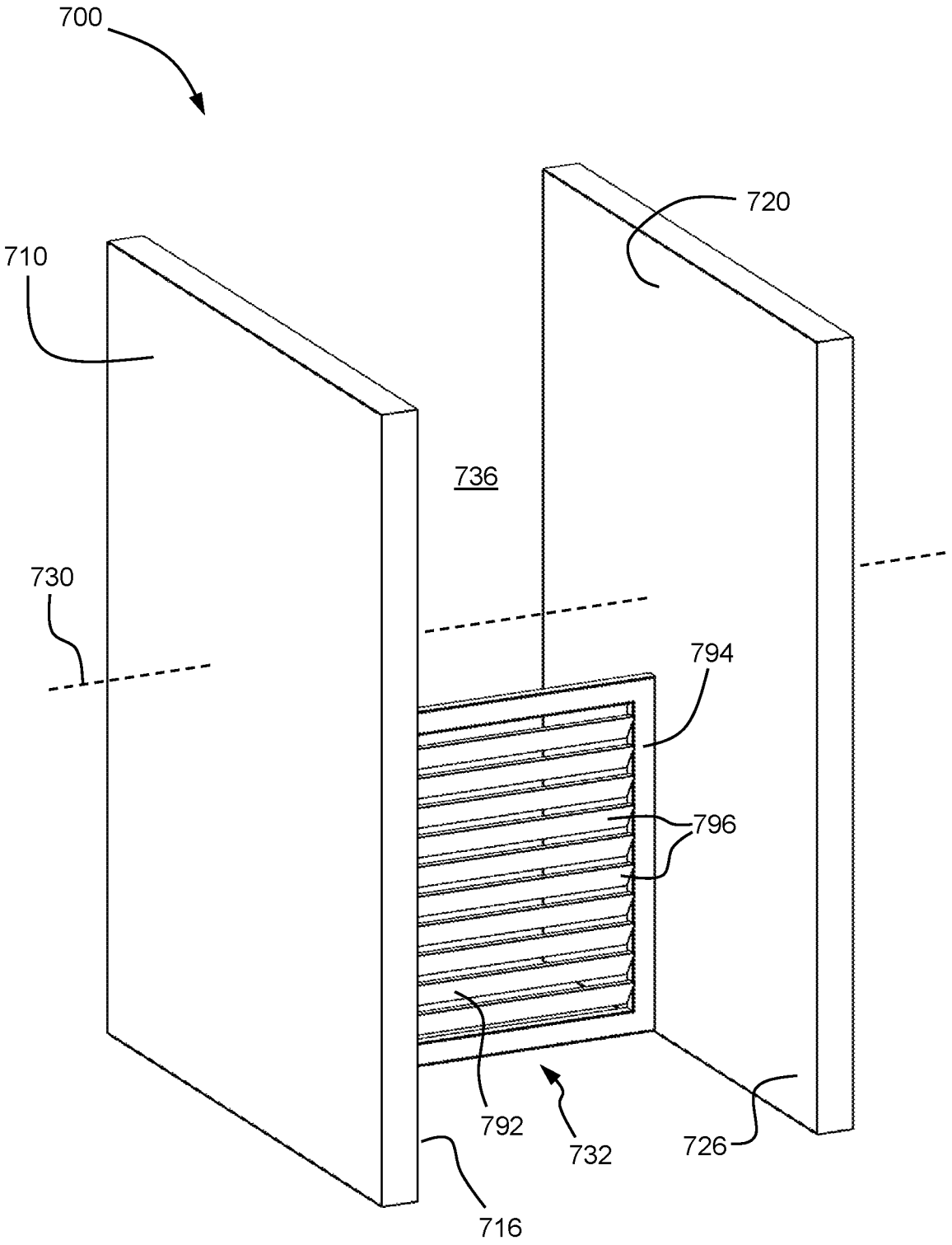
FIG. 7 shows a shooting stall, according to an example embodiment.
Figure 8:
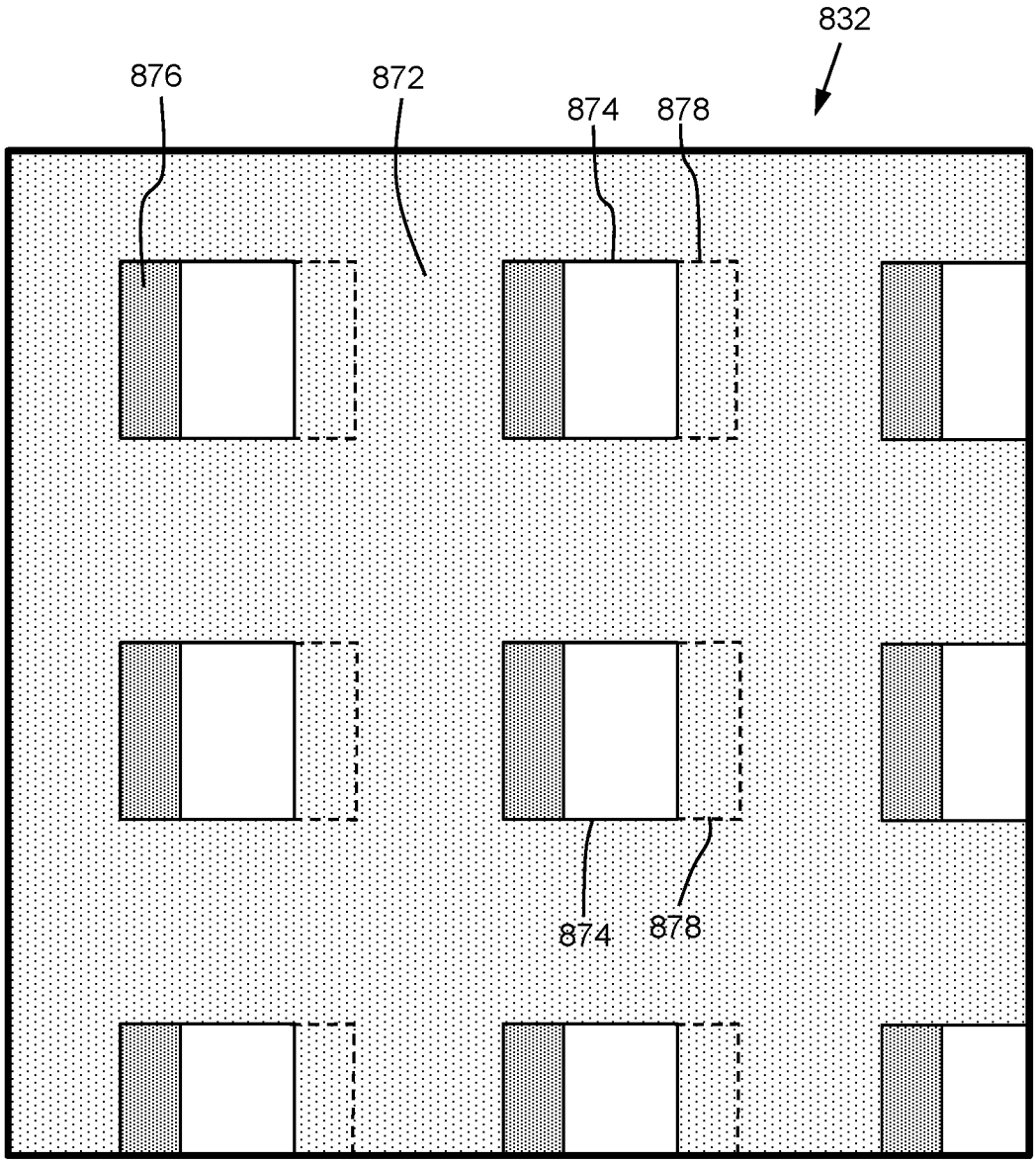
FIG. 8 shows a detailed view of aspects of an air permeable barrier, according to an example embodiment.
Figure 9:
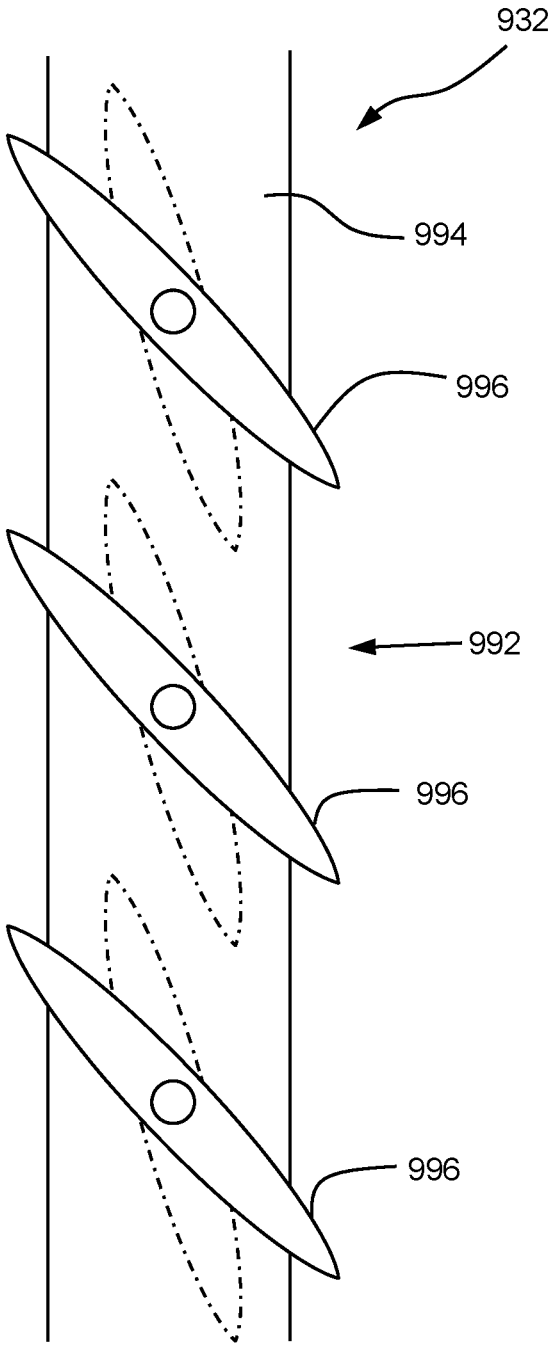
FIG. 9 shows a detailed view of aspects of an air permeable barrier, according to an example embodiment.
Figure 10:
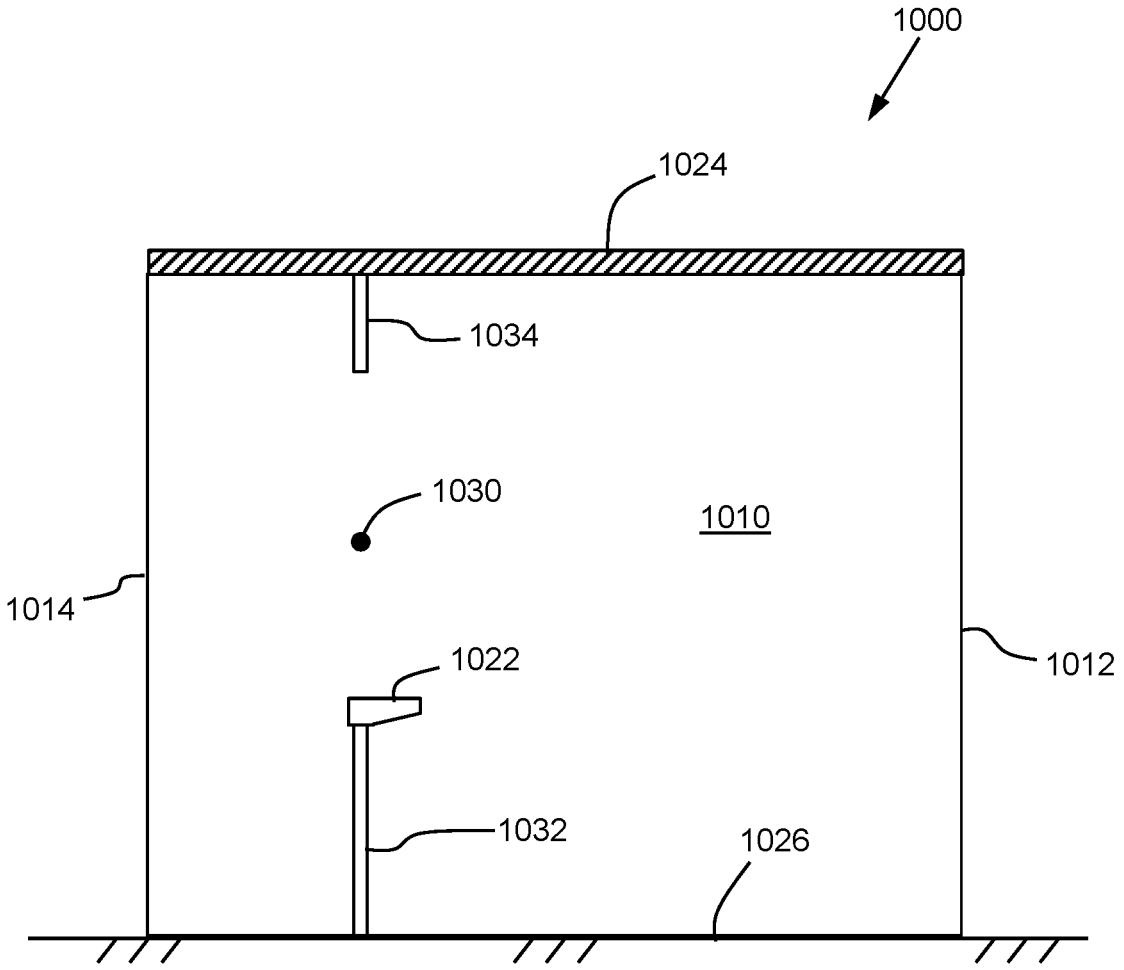
FIG. 10 shows a shooting stall, according to an example embodiment.

FIGS. 1-11 show shooting stalls, shooting ranges, aspects of shooting stalls, and aspects of shooting ranges, according to example embodiments. FIGS. 1, 4A, 4B, 5-7, 11 are perspective views, FIGS. 2 and 3 are plan views, FIG. 10 is a cross-sectional elevation view, FIG. 8 is a detailed elevation view, and FIG. 9 is a detailed cross-sectional side view. FIGS. 1-11 are provided for purposes of illustration only and components of the shooting stalls and shooting ranges depicted in the Figures are not to scale. Further, components of shooting stalls and shooting ranges depicted in the Figures with the same or similar reference numerals in different Figures may take the same or similar form and operate in the same or similar manner unless otherwise noted.

FIG. 1 shows a shooting stall 100, according to an example embodiment. The shooting stall 100 includes a first wall 110, a second wall 120 disposed substantially parallel to the first wall 110, and an air permeable barrier 132 disposed between the first wall 110 and the second wall 120. The shooting stall 100 also includes an open region 136 above the air permeable barrier 132 where there is no restriction across the shooting stall. In some embodiments, the air permeable barrier 132 may be disposed along an axis 130 that is substantially perpendicular to the first wall 110 and second wall 120 and that extends through the first wall 110 and the second wall 120. In some embodiments, the first wall 110 and the second wall 120 may form an enclosed space for an occupant. Further, in some embodiments, the axis 130 may be coplanar with a firing line of the shooting stall 100. The occupant may discharge his firearm at or behind the firing line. The term "substantially parallel," as used in this disclosure, means exactly parallel or one or more deviations from exactly parallel that do not significantly impact air flow through shooting stalls as described herein (e.g., 1-10 degrees off of parallel). Likewise, the term "substantially perpendicular," as used in this disclosure, means exactly perpendicular or one or more deviations from exactly perpendicular (e.g., 1-10 degrees off of perpendicular).

FIG. 2 shows a plan view of the shooting stall 100. As illustrated in FIG. 2, the shooting stall 100 forms an enclosed space for the occupant 140 between the first wall 110 and the second wall 120. The occupant 140 is standing in the shooting stall 100 and aiming a firearm so as to define a downstream direction. Further, the occupant 140 is positioned upstream of the air permeable barrier 132. The first wall 110 includes an upstream end 112, a downstream end 114, and a side surface 116 that extends between the upstream end 112 and the downstream end 114. The axis 130 is positioned between the upstream end 112 and the downstream end 114.

The first wall 110 may be constructed from a variety of materials, including, for example, wood, steel, and concrete. Further, the first wall 110 may have a variety of dimensions, including, for example, a length in a range of 6 feet to 8 feet, and a height in a range of 8 feet to 10 feet.

The second wall 120 may have a similar arrangement as the first wall 110. The second wall 120 includes an upstream end 122, a downstream end 124, and a side surface 126 that extends between the upstream end 122 and the downstream end 124. The axis 130 is positioned between the upstream end 122 and the downstream end 124.

The second wall 120 may be constructed of any of the materials of the first wall 110. In some embodiments, the second wall 120 may include the same materials as the first wall 110. Further, in some embodiments, the second wall 120 may include different materials than the first wall 110. Moreover, in some embodiments, the second wall 120 may have the same dimensions as the first wall 110. Further, in some embodiments, the second wall 120 may have different dimensions than the first wall 110.

The second wall 120 is positioned at a predefined distance along the axis 130 from the first wall 110. The distance between the first wall 110 and the second wall 120 may have a variety of dimensions, including, for example, a distance in a range of 30 inches to 60 inches. In some embodiments, the first wall 110 and the second wall 120 are aligned with respect to the axis 130. For example, as shown in FIG. 2, in some embodiments, the distance from the upstream end 112 of the first wall 110 to the axis 130 is the same as the distance from the upstream end 122 of the second wall 120 to the axis 130. In other embodiments, the first wall 110 and the second wall 120 may be staggered with respect to the axis 130. For example, in some embodiments, the distance between the upstream end 112 of the first wall 110 and the axis 130 is different from the distance between the upstream end 122 of the second wall 120 and the axis 130.

The air permeable barrier 132 forms a constriction across the shooting stall 100, which may cause, at least in part, an increase in velocity of air that flows across the axis 130 through the open region 136. The air flow of increased velocity may flow away from occupant 140. For example, the air speed (e.g., FPM) at axis location 170 within the open region 136 above air permeable barrier 132 may be greater than air speed at upstream location 160 and/or air speed at downstream location 180. In some embodiments, the air speed at upstream location 160 may be substantially equal to the air speed at downstream location 180, and the air permeable barrier 132 may cause the air speed at axis location 170 to be 1.25 greater than the air speed at upstream location 160 and the air speed at downstream location 180. The term "substantially equal," as used in this disclosure, means exactly equal or one or more deviations from exactly equal that do not significantly impact air flow through shooting stalls as described herein (e.g., 1-3% difference).

While air permeable barrier 132 forms the constriction across the shooting stall 100, it allows some passage of air therethrough. In some embodiments, the ability for a portion of the air flow to travel through the air permeable barrier 132 avoids the possibility of an eddy forming behind the air permeable barrier 132, which would recirculate the air and could allow toxic components in the air to linger within the shooting stall 100.

FIG. 3 shows a shooting range 300, according to an example embodiment. The shooting range 300 includes a plurality of walls 310, an axis 330 that passes through the plurality of walls 310, an air handling system 350, a plurality of targets 360, and a backstop 370. The plurality of walls 310 defines a plurality of shooting stalls 320.

The plurality of walls 310 includes four walls 310A, 310B, 310C, and 310D. The walls 310A, 310B, 310C, and 310D are substantially parallel. In some embodiments, the plurality of walls may include more or less than four walls. For example, a plurality of walls may include between two walls to sixteen walls.

The plurality of shooting stalls 320 includes three stalls 320A, 320B, and 320C. In some embodiments, the plurality of shooting stalls may include more or less than three stalls. For example, a plurality of shooting stalls may include between two stalls and fifteen stalls. Occupants 340A-340C may discharge their firearms in shooting stalls 320A-320C, respectively. Each of the occupants may discharge his firearm at or behind the axis 330.

The plurality of targets 360 includes three targets 360A, 360B, and 360C. In some embodiments, the plurality of targets 360 may include more or less than three targets. Each of the occupants may discharge his firearm at a corresponding target. The target 360A corresponds with the shooting stall 320A, the target 360B corresponds with the shooting stall 320B, and the target 360C corresponds with the shooting stall 360C. The backstop 370 may be configured to stop or absorb bullets from firearms.

Each of the walls 310A, 310B, 310C, and 310D includes an upstream end (312A-312D, respectively), a downstream end (314A-314D, respectively), a first side surface extending from the upstream end to the downstream end, and a second side surface extending from the upstream end to the downstream end (316A, 316B1, 316B2, 316C1, 316C2, and 316D, respectively).

Each of the shooting stalls 320A, 320B, and 320C includes a respective air permeable barrier 332A, 332B, and 332C disposed between the respective walls 310A, 310B, 310C, and 310D of the shooting stalls. For example, first stall 320A includes air permeable barrier 332A disposed between first wall 310A and second wall 310B, the second stall 320B includes an air permeable barrier 332B disposed between second wall 310B and third wall 310C, and the third stall 320C includes an air permeable barrier 332C disposed between the third wall 310C and the fourth wall 310D.

The first shooting stall 320A includes an air permeable barrier 332A that extends across the shooting stall 320A between the first wall 310A to the second wall 310B. In particular, the air permeable barrier 332A extends from the second side surface 316A of the first wall 310A to the first side surface 316B1 of the second wall 310B. Moreover, the air permeable barrier 332A extends across a lower portion of the shooting stall 320A and leaves an upper area between the first wall 310A and the second wall 310B free of any obstruction, allowing the occupant 340A to shoot toward the respective target 360A.

The shooting stalls 320B and 320C may each take the same or similar form as the shooting stall 320A. In this regard, air permeable barrier 332B extends across a lower portion of the shooting stall 320B, and air permeable barrier 332C extends across a lower portion of the shooting stall 320C.

The air handling system 350 may be configured to maintain an air flow in the shooting range 300 within a range of 50 FPM to 75 FPM. The air handling system 350 includes an inlet 352 to the shooting range 300 and an outlet 354 from the shooting range. The inlet 352 is positioned upstream of the shooting stalls 320A, 320B, and 320C. The inlet 352 may be configured to provide air to the shooting range 300. The outlet 354 is positioned downstream of the shooting stalls 320A, 320B, and 320C. The outlet 354 may be configured to collect air that has flowed from the inlet 352 through the shooting range 300. The air handling system 350 includes at least one air mover. In some embodiments, the at least one mover may be coupled to the inlet 352 and/or the outlet 354. Further, in some embodiments, the at least one air mover may include one or more blowers, compressors, pumps, and other HVAC equipment.

In some embodiments, the outlet 354 may be configured to filter at least a portion of the collected air and transfer the filtered air to the inlet 352. The inlet 352 and the outlet 354 may each include blowers, compressors, pumps, and other HVAC equipment.

Beneficially, the air permeable barriers 332A, 332B, and 332C may result in a safety benefit for the shooting range 300. In some embodiments, the air permeable barriers 332A, 332B, and 332C may cause an increase in the velocity of air that flows across the axis 330, which may in turn increase removal of toxic components from the air in the shooting range 300. As one example, the increase in the velocity of air that flows across the axis 330 may result in an increase in toxic components collected by the outlet 354. The air permeable barriers 332A, 332B, and 332C may improve ventilation of the shooting range 300.

A parameter of the shooting range 300 may be selected based at least in part on the air permeable barrier 332A, 332B, and/or 332C, for example, based on the air flow through, or the pressure drop across, the air permeable barrier 332A, 332B, and/or 332C. In some embodiments, the selected parameter may be the air volume supplied to the air handling system 350. Further, in some embodiments, the selected parameter may be the air speed at the axis 330.

Beneficially, the air permeable barriers 332A, 332B, and 332C may result in an energy benefit for the shooting range 300. In some embodiments, the air permeable barriers 332A, 332B, and 332C may cause an increase of velocity of air that flows across the axis 330, which may in turn permit a reduction in the air volume supplied to the inlet 352. Further, in some embodiments, the air permeable barriers 332A, 332B, and 332C may cause an increase of velocity of air that flows across the axis 330, which may in turn permit a reduction in the electrical power to operate the inlet 352 and/or the outlet 354.

Although the air permeable barriers 332A, 332B, and 332C are described above as having a safety benefit and an energy benefit for the shooting range 300, each air permeable barrier 332A, 332B, and 332C may have a safety benefit and/or an energy benefit. In other words, in some embodiments, the configuration of the air permeable barriers may provide a safety benefit without a substantial or any energy benefit. Likewise, in other embodiments, the air permeable barriers may provide an energy benefit without a substantial or any safety benefit.

Figure 4A:
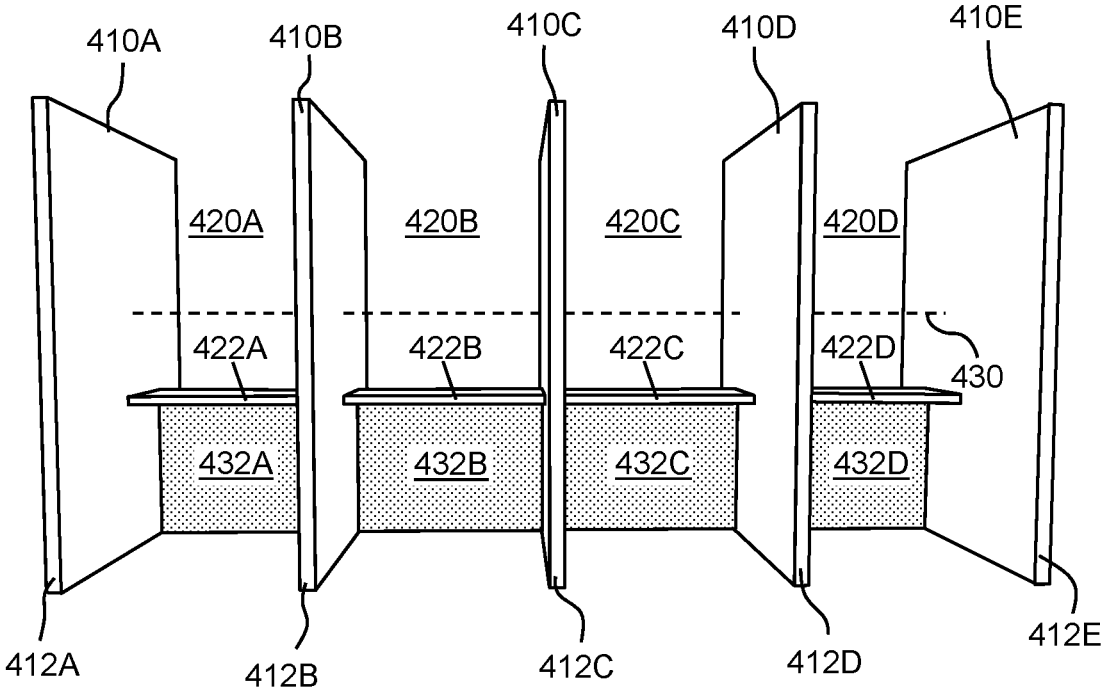
FIG. 4A shows aspects of a shooting range, according to an example embodiment.
Figure 4B:
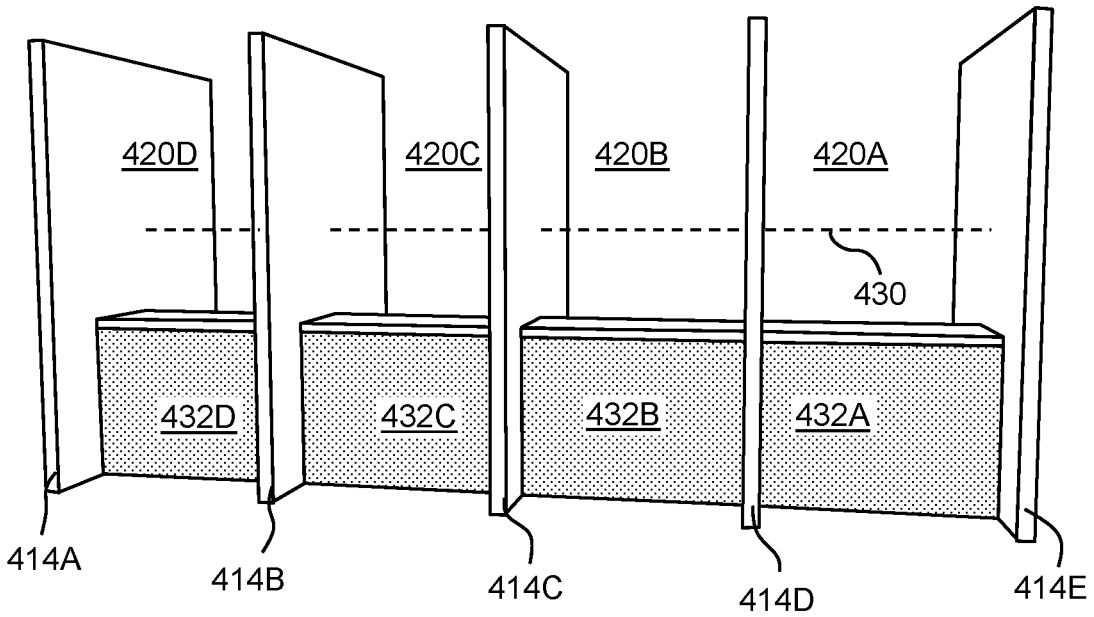
FIG. 4B shows aspects of a shooting range, according to an example embodiment.

FIGS. 4A and 4B show aspects of a shooting range 400, according to an example embodiment. The shooting range 400 includes five walls 410A, 410B, 410C, 410D, and 410E, and an axis 430 that passes through the walls 410A, 410B, 410C, 410D, and 410E. Each of the walls include an upstream end (412A-412E, respectively) and a downstream end (414A-414E, respectively). FIG. 4A is a view of the shooting range 400 from the upstream ends of the walls, and FIG. 4B is a view of the shooting range 400 from the downstream ends of the walls. The shooting stalls 420A, 420B, 420C, and 420D each include a respective air permeable barrier 432A, 432B, 432C, and 432D. The air permeable barriers 432A-432D may each include the same or a similar configuration as those air permeable members used in the shooting stalls 320A, 320B, and 320C, shown in FIG. 3.

The shooting stall 420A includes a shelf 422A. The axis 430 may be aligned with an edge of the shelf 422A. The shelf 422A may provide a structural barrier for an occupant of the shooting stall 420. Further, the shelf 422A may provide a surface for the occupant in the shooting stall 420. The shelf 422A may be constructed from a variety of materials, including, for example, any of the materials that the first wall 110 may be constructed.

The shooting stall 420B includes a shelf 422B, the shooting stall 420C includes a shelf 422C, and the shooting stall 420D includes a shelf 422D. The shelfs 422B, 422C, and 422D may take the same or similar form and have similar connections as the shelf 422A.

In some embodiments, a shooting stall may include an air permeable barrier that extends across a majority of the shooting stall. For example, in some embodiments, the air permeable barrier may extend across at least 60% of the gap between the first wall and the second wall of the shooting stall. In other embodiments, the air permeable barrier may extend across at least 70% of the gap between the first wall and the second wall of the shooting stall. Still, in some embodiments, the air permeable barrier may extend across at least 80% of the gap between the first wall and the second wall. Further, in some embodiments the air permeable barrier extends to within 1-2 inches of the first wall and to within 1-2 inches of the second wall. Still, in some embodiments, the air permeable barrier extends all the way across the gap between the first wall and the second wall. For example, in shooting stall 100, the air permeable barrier 132 extends from the side surface 116 of the first wall 110 to the side surface 126 of second wall 120.

In some embodiments, a shooting stall may include an air permeable barrier that extends over a height of at least 1.5 feet. In some embodiments, a shooting stall may include an air permeable barrier that extends over a height of at least 2 feet, for example an air permeable barrier having a height of three feet. In some embodiments, the air permeable barrier may extend down to the support surface, or floor, that supports the shooting stall walls. In other embodiments, the air permeable barrier may extend to within 1 foot from the support surface, for example, the air permeable barrier may extend to within 3-9 inches from the support surface.

In some embodiments, a shooting stall may include an air permeable barrier that extends up to a height of at least 2 to 4 feet. For example, in some embodiments, the shooting stall may include an air permeable barrier that extends up to a height of about 3 feet. In some embodiments, the shooting stall may include a shelf and the air permeable barrier may extend up to the shelf.

In some embodiments the air permeable barrier may be substantially uniform in air permeability across its surface. In other embodiments, the air permeable barrier may have areas of air permeability and other areas where the flow of air is restricted. For example, in some embodiments, the air permeable barrier may include an outside border that blocks air flow around the outer edge of the barrier but allows air flow through the center of the air permeable barrier. In other embodiments, the center of the air permeable barrier may be solid. For example some embodiments may include a plate exhibiting a logo that is positioned in the center of the air permeable barrier.

In some embodiments the air permeable barrier includes a diffuser. The diffuser may be in the form of a planar structure or plate that includes a number of openings for directing and controlling the flow of fluid therethrough. The diffuser directs compressed air through the openings across the surface thereof, forming a distributed air flow. In some embodiments, the diffuser may reduce unwanted circulations of air, while still reducing the air flow through the air permeable barrier, so as to promote faster flow through other portions of the shooting stall.

In some embodiments, the air permeable barrier includes a grille. Such an air permeable barrier is shown in FIG. 1. Air permeable barrier 132 includes a grille 162, which includes a grating of bars with openings therebetween. The grille 162 helps direct a somewhat restricted but uniform flow of air through the air permeable barrier 132.

Figure 5:
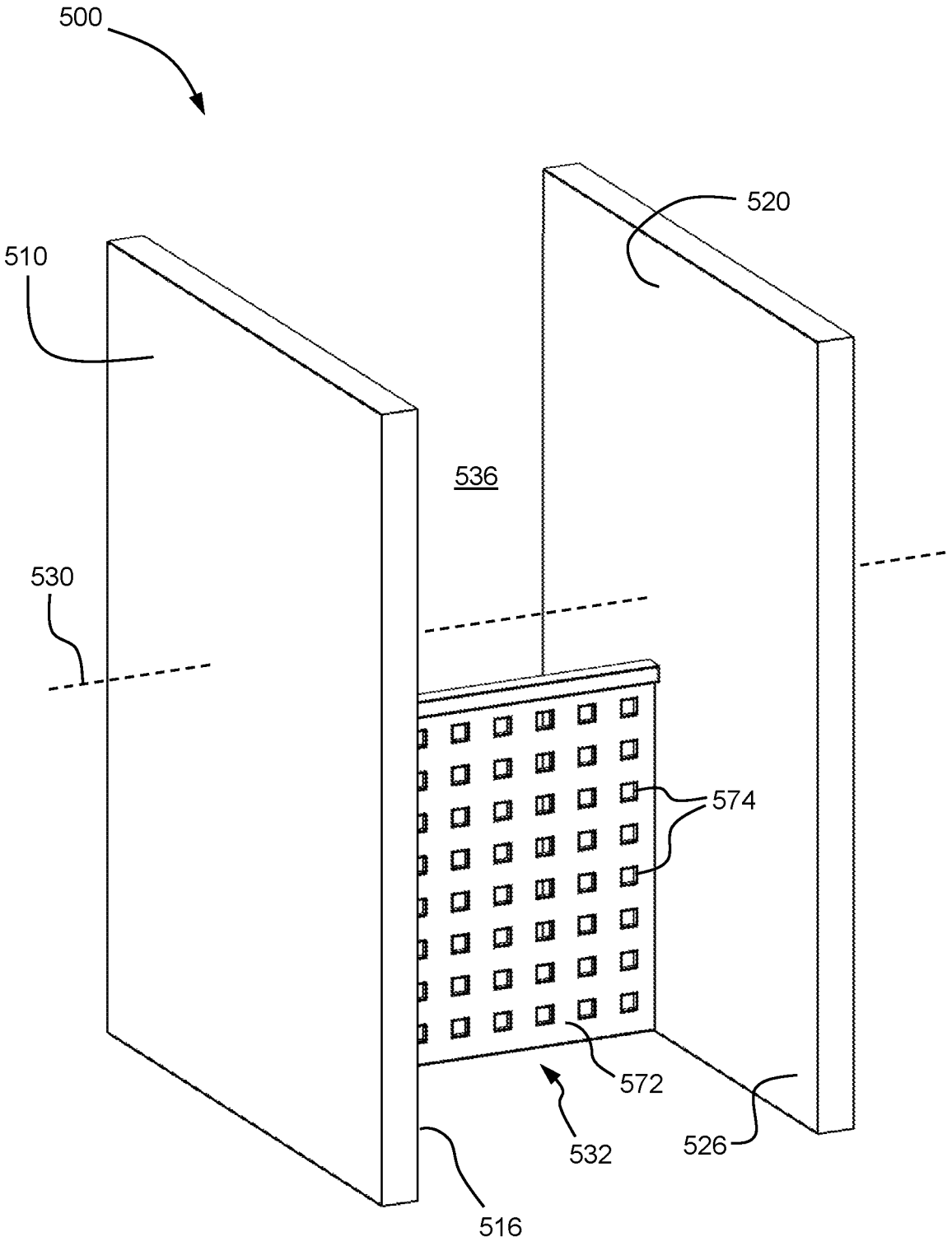
FIG. 5 shows a perspective view of a shooting stall, according to an example embodiment.

FIG. 5 shows a shooting stall 500 according to another example embodiment. The shooting stall 500 includes a first wall 510, a second wall 520 disposed substantially parallel to the first wall 510, and an air permeable barrier 532 disposed between the first wall 510 and the second wall 520. The shooting stall 500 also includes an open region 536 above the air permeable barrier 532 where there is no restriction across the shooting stall. In some embodiments, the air permeable barrier 532 may be disposed along an axis 530 that is substantially perpendicular to the first wall 510 and second wall 520 and that extends through the first wall 510 and the second wall 520.

The air permeable barrier 532 may include a perforated plate 572 formed by a sheet of solid material having regularly or irregularly spaced apertures 574 extending therethrough. The apertures 574 may have a variety of different shapes. For example, in some embodiments, the apertures 574 may be rectangular, while in other embodiments, the apertures may be round or have another polygonal shape. Furthermore, the apertures 574 may be uniform in size, or they may have a range of different sizes. In some embodiments, the apertures 574 have a width in a range of ¼ inch to 4 inches. In some embodiments, the perforated plate 572 may be formed of a metal, such as aluminum or steel, for example. In other embodiments, the perforated plate 572 may be formed of a rigid or semi-rigid plastic, such as polycarbonate or polyvinylchloride, for example. Still, in other embodiments, the perforated plate 572 may be formed by other materials, such as wood.

The air permeable barrier 532 may extend from a side surface 516 of the first wall 510 of the shooting stall 500 to a side surface 526 of the second wall 520 of the shooting stall 500. Further, the air permeable barrier 532 may extend downward to the support surface or floor below the shooting stall.

FIG. 6 shows a shooting stall 600 according to another example embodiment. The shooting stall 600 includes a first wall 610, a second wall 620 disposed substantially parallel to the first wall 610, and an air permeable barrier 632 disposed between the first wall 610 and the second wall 620. The shooting stall 600 also includes an open region 636 above the air permeable barrier 632 where there is no restriction across the shooting stall. In some embodiments, the air permeable barrier 632 may be disposed along an axis 630 that is substantially perpendicular to the first wall 610 and second wall 620 and that extends through the first wall 610 and the second wall 620.

The air permeable barrier 632 may include a screen 682 held in place by a frame 684. In some embodiments, the screen 682 may be formed by a plurality of metal wires that stretch across the frame 684. The metal wires may be woven or non-woven. In other embodiments, the screen 682 may be formed by fibrous material. For example, in some embodiments, the screen 682 may be formed by fabric. In other embodiments, the screen 682 may be formed by cellulose or glass fibers. The fibers can be woven or non-woven. For example, in some embodiments, the screen may 682 have a construction similar to an air filter.

The air permeable barrier 632 may extend from a side surface 616 of the first wall 610 of the shooting stall 600 to a side surface 626 of the second wall 620 of the shooting stall 600. Further, the air permeable barrier 632 may extend downward to the support surface or floor below the shooting stall.

FIG. 7 shows a shooting stall 700 according to another example embodiment. The shooting stall 700 includes a first wall 710, a second wall 720 disposed substantially parallel to the first wall 710, and an air permeable barrier 732 disposed between the first wall 710 and the second wall 720. The shooting stall 700 also includes an open region 736 above the air permeable barrier 732 where there is no restriction across the shooting stall. In some embodiments, the air permeable barrier 732 may be disposed along an axis 730 that is substantially perpendicular to the first wall 710 and second wall 720 and that extends through the first wall 710 and the second wall 720.

The air permeable barrier 732 may include a vent 792 formed by louvers 796 extending across a frame 794. In some embodiments, the vent 792 and its louvers 796 may be formed of a metal, a rigid or semi-rigid plastic, or another material, such as wood.

The air permeable barrier 732 may extend from a side surface 716 of the first wall 710 of the shooting stall 700 to a side surface 726 of the second wall 720 of the shooting stall 700. Further, the air permeable barrier 732 may extend downward to the support surface or floor below the shooting stall.

The air permeable barrier of the disclosure provides some restriction to air flowing therethrough in order to promote air flow through the open region of the shooting stall. Accordingly, the air flow through the open region of the shooting stall will increase in velocity, as explained above. In some embodiments, the air running through the air permeable barrier flows through a free area, also known as an open area or "see-through" area", in the air permeable barrier. The free area of the air permeable barrier may be formed, for example, by the apertures in a perforated plate, or by the space between the bars of a grille. The free area of the air permeable barrier may have various different values. In some embodiments, the free area of the air permeable barrier may be in a range from 25% to 75%. In other embodiments, the air permeable barrier may allow air flow therethrough without having a free area, for example, the air permeable barrier may include a porous material without a free area.

In some embodiments, the shooting stall may include an air permeable barrier that is adjustable so as to allow a greater or lesser flow of air through therethrough. For example, in some embodiments, the air permeable member may be adjustable to vary the free area of the air permeable member.

FIG. 8 shows an example embodiment of an adjustable air permeable barrier 832. In particular, FIG. 8 shows a detailed elevation view of a small section of an air permeable barrier 832 according to an example embodiment. The air permeable barrier 832 may include a first perforated plate 872 and a second perforated plate 876. The first perforated plate 872 may include apertures 874 in the shape of squares and the second perforated plate 876 may include apertures 878 that are in the shape of similarly sized squares. In order to increase the free area of the air permeable barrier 832, the apertures 874 and 878 may be aligned so that the opening through the perforated plates 872 and 876 is increased. In order to decrease the free area of the air permeable barrier 832, the apertures 874 and 878 may be misaligned so that the apertures 874 and 878 are blocked by portions of the other respective perforated plate 872, 876. In the position shown in FIG. 8, the apertures 874 and 878 are overlapping so as to form holes through the air permeable barrier 832 that are about 60% of the size of each aperture.

FIG. 9 shows another example embodiment of an adjustable air permeable barrier 932. In particular, FIG. 9 shows a detailed cross-sectional side view of a small section of an air permeable barrier 932 according to an example embodiment. The air permeable barrier 932 may include a vent 992 having adjustable louvers 996 that are rotatably mounted on a frame 994. The free area of the air permeable barrier 932 can be increased by positioning the louvers 996 to be at a shallower angle. On the other hand, the free area of the air permeable barrier 932 can be reduced by positioning the louvers 996 to be at a steeper angle. In the position shown in FIG. 9, the louvers 996 are in an intermediate position. A second position of the louvers 996, resulting in a smaller free area, is shown using dashed lines in FIG. 9.

In some embodiments, a shooting range may include a first shooting stall including an air permeable barrier having a first free area and a second shooting stall including an air permeable barrier having a second free area that is different from the first free area. For example, in some embodiments, a shooting range may include shooting stalls that include adjustable air permeable barriers, and where the air permeable barrier in the first shooting stall is set to a position having a first free area while the air permeable barrier in the second shooting stall is set to a different position that has a second free area that is larger or smaller than the first free area. The use of air permeable barriers that have different free areas may be useful where the air flow within the shooting range varies from one shooting stall to the next shooting stall. Accordingly, the difference in air flow through the shootings stalls can be accommodated, at least in part, by the use of air permeable barriers with different flow characteristics, for example based on a difference in free areas of the air permeable barriers. While some embodiments may use adjustable air permeable barriers to vary the free area of the air permeable barrier from one shooting stall to the next, in other embodiments, different air permeable barriers with predefined free areas may be installed in adjacent shooting stalls in order to vary the free area of the air permeable barriers throughout the shooting range.

In some embodiments, a shooting stall may include an upper air permeable barrier. FIG. 10 shows aspects of a shooting stall 1000, according to an example embodiment. The shooting stall 1000 includes a wall 1010, a ceiling 1024 disposed over the wall 1010, and an axis 1030 that passes through the wall (axis 1030 is shown into and out of page).

The wall 1010 includes an upstream end 1012 and a downstream end 1014. The shooting stall also includes a lower air permeable barrier 1032 disposed between the upstream end 1012 and the downstream end 1014 as well as an upper air permeable barrier 1034 disposed between the upstream end 1012 and the downstream end 1014. The lower air permeable barrier 1032 is disposed at the bottom of the shooting stall 1000 next to the support surface, or floor 1026, on which wall 1010 is supported. The upper air permeable barrier 1034 is disposed at the top of the shooting stall 1000 adjacent to the ceiling 1024. The lower air permeable barrier 1032 and the upper air permeable barrier are both perpendicular to wall 1010 and aligned with axis 1030. A shelf 1022 is also aligned with axis 1030 and is disposed at the upper end of lower air permeable barrier 1032.

In some embodiments, the upper air permeable barrier 1034 may have a similar or identical configuration as the lower air permeable barrier 1032. For example, both the upper air permeable barrier 1034 and the lower air permeable barrier 1032 may be formed as grilles, screens or perforated plates. In other embodiments, the upper air permeable barrier 1034 and the lower air permeable barrier 1032 may have different configurations. For example, the lower air permeable member 1032 may be in the form of a grille, while the upper air permeable member is in the form of a screen.

The ceiling 1024 may be constructed from a variety of materials, including, for example, any of the materials that the first wall 110 may be constructed. In some embodiments, the ceiling 1024 may be substantially flat. The term "substantially flat," as used in this disclosure, means exactly flat or one or more deviations from exactly flat that do not significantly impact air flow through shooting stalls described herein (e.g., 1-2% off of flat).

The lower air permeable member 1032 and the upper air permeable member 1034 may cause, at least in part, an increase in velocity of air that flows across the axis 1030, which may in turn increase removal of toxic components from the air in the shooting range. Further, the lower air permeable member 1032 and the upper air permeable member 1034 may cause at least in part an increase in velocity of air that flows across the axis 1030, which may in turn permit a reduction in air volume supplied to an air handling system and/or permit a reduction in the electrical power to operate an air handling system.

Figure 11:
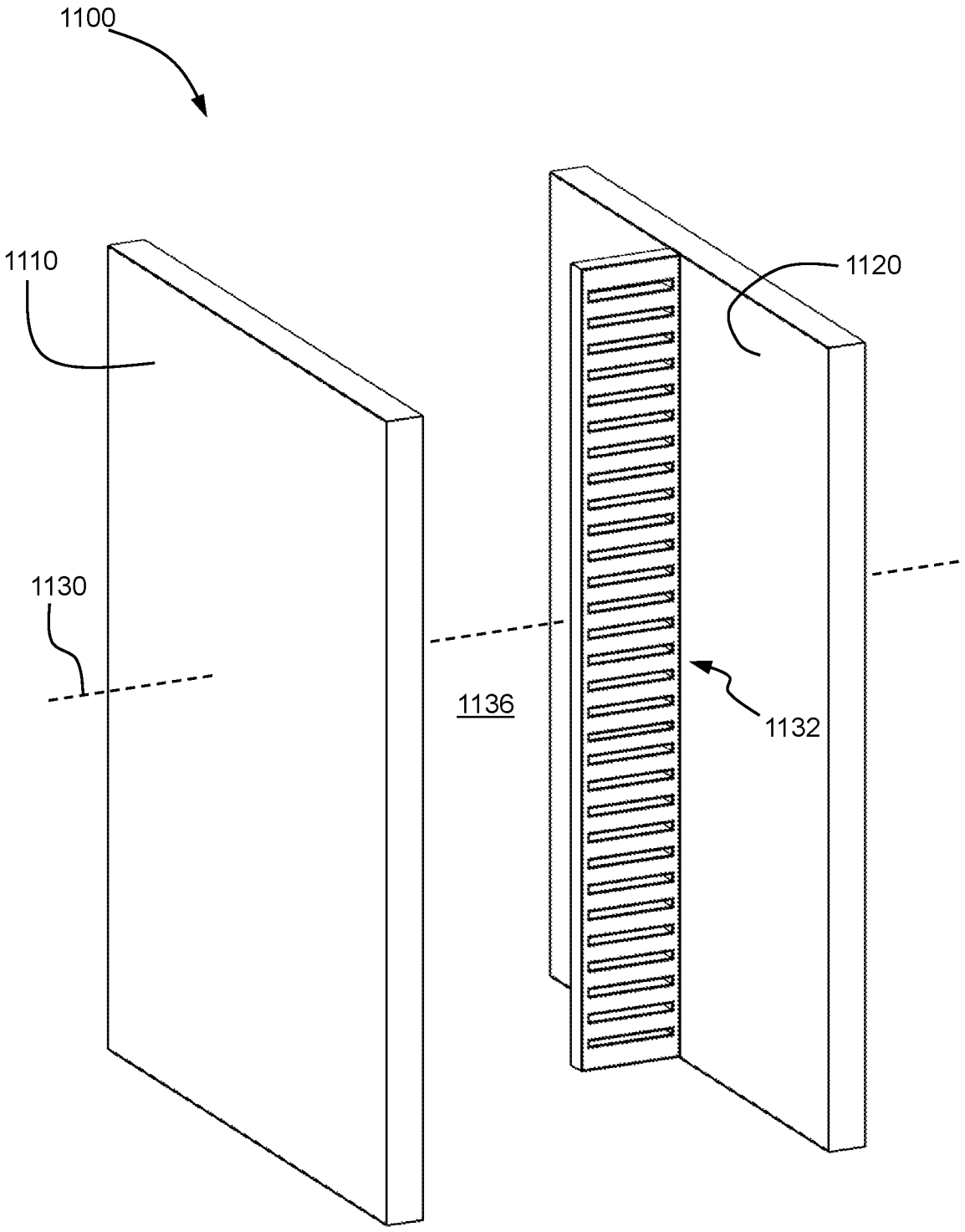
FIG. 11 shows a shooting stall, according to an example embodiment.

A shooting range may also include an upper air permeable barrier without the lower air permeable member. Other configurations of air permeable barriers are also possible. For example, FIG. 11 shows a shooting stall 1100 according to another example embodiment. The shooting stall 1100 includes a first wall 1110, a second wall 1120 disposed substantially parallel to the first wall 1110, and an air permeable barrier 1132 disposed between the first wall 1110 and the second wall 1120. The shooting stall 1100 also includes an open region 1136 adjacent to the air permeable barrier 1132 where there is no restriction to air flowing through the shooting stall 1100. The air permeable barrier 1132 may be a side air permeable barrier that is adjacent to the second wall 1120 and that extends laterally toward a center of the shooting stall 1100. In some embodiments, the air permeable barrier 1132 may be disposed along an axis 1130 that is substantially perpendicular to the first wall 1110 and second wall 1120 and that extends through the first wall 1110 and the second wall 1120. In some embodiments, a shooting stall may include two side air permeable barriers that respectively extend inward toward the center of the shooting stall from each of the first wall and the second wall. Combinations of side air permeable barriers along with the other air permeable barriers described herein are also possible. Further, the side air permeable barriers may take the form of any of the other described air permeable barriers, for example, as a perforated plate, screen, grille, or vent.

A shooting range may include a group of any of the shooting stalls described herein. For example, a shooting range may include a group of shooting stalls 100, a group of shooting stalls 500, a group of shooting stalls 600, or a group of shooting stalls 700. Further, a shooting range may include air permeable barriers of any of those described herein, including a group of air permeable barrier 132, a group of air permeable barrier 532, a group of air permeable barrier 632, a group of air permeable barrier 732, a group of air permeable barrier 832 or a group of air permeable barrier 932. Further, a shooting range may include, a combination of any of the shooting stalls described herein. For example, a shooting range may include shooting stall 100, shooting stall 1000, shooting stall 500, shooting stall 600, and shooting stall 700. Likewise, a shooting range may include a combination of any of the air permeable barriers described herein. For example, a shooting range may include a shooting stall that includes air permeable barrier 132, a shooting stall that includes air permeable barrier 532, a shooting stall that includes air permeable barrier 632, a shooting stall that includes air permeable barrier 732, a shooting stall that includes air permeable barrier 832, and a shooting stall that includes air permeable barrier 932. Further, in some embodiments, a shooting range may include a first group of one or more shooting stalls having any combination of the air permeable barriers described herein, and another group of one or more shooting stalls that do not include any air permeable barrier.

III. Conclusion

Examples given above are merely illustrative and are not meant to be an exhaustive list of all possible embodiments, applications or modifications of the disclosure. Thus, various modifications and variations of the described methods and systems of the disclosure will be apparent to those skilled in the art without departing from the scope and spirit of the disclosure.

It is understood that the disclosure is not limited to the particular methodology, protocols, etc., described herein, as these may vary as the skilled artisan will recognize. It is also to be understood that the terminology used herein is used for the purpose of describing particular embodiments only, and is not intended to limit the scope of the disclosure. It also is to be noted that, as used herein and in the appended embodiments, the singular forms "a," "an," and "the" include the plural reference unless the context clearly dictates otherwise. Thus, for example, a reference to "a structure" is a reference to one or more structures and equivalents thereof known to those skilled in the art.

Unless defined otherwise, all technical and scientific terms used herein have the same meanings as commonly understood by one of ordinary skill in the art. The embodiments of the disclosure and the various features and advantageous details thereof are explained more fully with reference to the non-limiting embodiments and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein.

Any numerical values recited herein include all values from the lower value to the upper value in increments of one unit provided that there is a separation of at least two units between any lower value and any higher value. As an example, if it is stated that the concentration of a component or value of a process variable such as, for example, size and the like, is, for example, from 1 to 90, specifically from 20 to 80, more specifically from 30 to 70, it is intended that values such as 15 to 85, 22 to 68, 43 to 51, 30 to 32, etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

The invention claimed is:

1. A shooting stall for a shooting range including a plurality of shooting stalls, the shooting stall comprising:

a first wall comprising an upstream end, a downstream end, and a side surface that extends between the upstream end and the downstream end;

a second wall disposed substantially parallel to the first wall so as to form an enclosure for an occupant, the second wall comprising an upstream end, a downstream end, and a side surface facing the first wall that extends between the upstream end and the downstream end; and an air permeable barrier disposed between the side surface of the first wall and the side surface of the second wall, wherein the air permeable barrier comprises a diffuser.

2. The shooting stall of claim 1, wherein the air permeable barrier is substantially perpendicular to the first wall.

3. The shooting stall of claim 1, wherein the diffuser comprises a perforated plate, grill, or screen.

4. The shooting stall of claim 1, wherein the air permeable barrier extends across a majority of the opening between the side surface of the first wall and the side surface of the second wall.

5. The shooting stall of claim 4, wherein the air permeable barrier extends from the side surface of the first wall to the side surface of the second wall.

6. The shooting stall of claim 1 further comprising an axis extending through the first wall and the second wall, wherein the axis is positioned between the upstream end and the downstream end of each of the first wall and second wall, and wherein the air permeable barrier is disposed at the axis.

7. The shooting stall of claim 1 further comprising a shelf that extends between the first wall and second wall, wherein the air permeable barrier is disposed below the shelf.

8. The shooting stall of claim 5, wherein the air permeable barrier extends from the shelf to a floor structure that supports the first wall and the second wall.

9. The shooting stall of claim 1, wherein a free area of the air permeable barrier is in a range from 25% to 75% of a surface area of the air permeable barrier.

10. The shooting stall of claim 1, wherein a free area of the air permeable barrier is adjustable.

11. The shooting stall of claim 1, further comprising a second air permeable barrier disposed between the first wall and the second wall.

12. The shooting stall of claim 11, wherein the second air permeable barrier is disposed at an upper end of the first wall and the second wall.

13. A shooting range comprising:

a plurality of walls that are substantially parallel and aligned such that an axis passes through the plurality of walls, each of the walls comprising an upstream end, a downstream end, a first side surface extending from the upstream end to the downstream end, and a second side surface extending from the upstream end to the downstream end, wherein the plurality of walls defines a plurality of shooting stalls, wherein a first shooting stall of the plurality of shooting stalls comprises:

a respective first side surface of a first wall of the plurality of walls, an opposing respective second side surface of a second wall of the plurality of walls, and a first air permeable barrier disposed between the second side surface of the first wall of the plurality of walls and the first side surface of the second wall of the plurality of walls, wherein the first air permeable barrier comprises a diffuser.

14. The shooting range of claim 13, wherein a second shooting stall of the plurality of shooting stalls comprises:

a respective first side surface of a third wall of the plurality of walls, an opposing respective second side surface of a fourth wall of the plurality of walls, and a second air permeable barrier disposed between the third wall of the plurality of walls and the fourth wall of the plurality of walls.

15. The shooting range of claim 14, wherein the first air permeable barrier has a first open area percentage and the second air permeable barrier has a second open area percentage, and wherein the first open area percentage is different from the second open area percentage.

16. The shooting range of claim 13, further comprising an air handling system configured to move air through the shooting stalls.

17. The shooting range of claim 16, wherein the air handling system moves air from an upstream end of the plurality of stalls to a downstream end of the plurality of stalls.

18. The shooting stall of claim 1, wherein the first and second walls are supported by a support surface, and wherein the air permeable barrier extends from a height within 1 foot of the support surface to a height in a range from 2 to 4 feet of the support surface.

19. The shooting stall of claim 1, wherein the air permeable barrier is substantially uniform in air permeability across a surface of the air permeable barrier.

20. The shooting stall of claim 1, wherein a distance between the first wall and the second wall is in a range of 30 to 60 inches.

* * * * *